US007452383B2

(12) United States Patent
Evers et al.

(10) Patent No.: US 7,452,383 B2
(45) **Date of Patent: *Nov. 18, 2008**

(54) DRY CLEANING PROCESS

(75) Inventors: Johannes Maria Evers, Vlaardingen (NL); Machiel Goedhart, Vlaardingen (NL); Freddie Kerpels, Vlaardingen (NL); Cornelis Gerhard Van Kralingen, Vlaardingen (NL); Pieter Everhardus Overdevest, Vlaardingen (NL); Hank Robert Reinhoudt, Vlaardingen (NL); Karin Vrieswijk, Vlaardingen (NL)

(73) Assignee: Unilever Home & Personal Care USA, Division of Conopco, Inc., Greenwich, CT (US)

( * ) Notice: Subject to any disclaimer, the term of this patent is extended or adjusted under 35 U.S.C. 154(b) by 490 days.

This patent is subject to a terminal disclaimer.

(21) Appl. No.: 10/538,999

(22) PCT Filed: Dec. 1, 2003

(86) PCT No.: PCT/EP03/13571

§ 371 (c)(1),
(2), (4) Date: Jun. 15, 2005

(87) PCT Pub. No.: WO2004/057092

PCT Pub. Date: Jul. 8, 2004

(65) Prior Publication Data

US 2006/0048307 A1 Mar. 9, 2006

(30) Foreign Application Priority Data

Dec. 19, 2002 (EP) ..... 02080474

(51) Int. Cl.
*D06L 1/00* (2006.01)

(52) U.S. Cl. ..... 8/142; 510/276; 510/284; 510/285; 510/291; 510/304; 510/338; 510/371

(58) Field of Classification Search ..... 510/285, 510/276, 284, 291, 304, 338, 371; 8/142
See application file for complete search history.

(56) References Cited

U.S. PATENT DOCUMENTS

| | | | | |
|---|---|---|---|---|
| 3,689,211 | A | 9/1972 | Giampalmi, Jr. et al. | |
| 6,846,790 | B2 * | 1/2005 | Evers et al. | 510/285 |
| 6,900,166 | B2 * | 5/2005 | Evers et al. | 510/285 |
| 7,244,276 | B2 * | 7/2007 | Evers et al. | 8/142 |
| 2002/0115582 | A1 * | 8/2002 | Perry et al. | 510/285 |
| 2002/0142932 | A1 * | 10/2002 | Goedhart et al. | 510/285 |
| 2003/0097718 | A1 * | 5/2003 | Evers et al. | 8/142 |

FOREIGN PATENT DOCUMENTS

| | | | |
|---|---|---|---|
| DE | 37 39 711 | A1 | 6/1989 |
| WO | 00/35571 | | 6/2000 |
| WO | 00/36206 | | 6/2000 |
| WO | 01/94684 | A1 | 12/2001 |
| WO | 02/46517 | A1 | 6/2002 |
| WO | 02/50366 | A1 | 6/2002 |
| WO | 02/053824 | A1 | 7/2002 |

OTHER PUBLICATIONS

International Search Report Application No. PCT/EP 03/13571 mailed Apr. 6, 2004.

* cited by examiner

*Primary Examiner*—Lorna M. Douyon
*Assistant Examiner*—Tri V Nguyen
(74) *Attorney, Agent, or Firm*—Ronald A. Koatz

(57) ABSTRACT

A dry cleaning process for in-home dry cleaning comprising a low aqueous dry cleaning step of contacting a laundry article with a low aqueous dry cleaning composition wherein the liquor to cloth ratio (w/w) (LCR) is at most 20, and wherein said low aqueous composition comprises: a) at least one non-flammable, non-chlorine containing organic dry cleaning solvent; b) 0.01 to 0.9 wt. % water and c) a cleaning effective amount of a surfactant wherein said surfactant comprises at least one anionic headgroup.

8 Claims, No Drawings

DRY CLEANING PROCESS

The present invention relates to a dry cleaning process for laundry articles.

Laundry articles can be cleaned using water as the primary medium with surfactants and other cleaning agents. However, not all laundry articles can be cleaned using water. These articles are cleaned in a dry cleaning process wherein an organic dry cleaning solvent is used as the primary medium. In dry cleaning usually the laundry articles are immersed in or washed with solvent liquids. Applications involving one or more stages of immersion, rinsing and/or drying are known. Solvents can be used at ambient temperature or at elevated temperatures up to the boiling point of the solvent.

Many alternative solvents have been proposed to replace perchloroethylene. Liquid carbondioxide is one example, but the high pressure equipment needed for this inorganic dry cleaning solvent makes it unpractical and prohibitively expensive. A novel and more promising class of dry cleaning solvents are the so called non-flammable, non-chlorine containing organic dry cleaning solvents. Examples may include hydrofluoroethers such as nonafluoromethoxybutane and nonafluoroethoxybutane or hydrofluorocarbons as decafluoropentane. Hydrofluoroethers are relatively low in toxicity, are claimed to have zero ozone depletion potential, have relatively short atmospheric lifetimes, and can have very low global warming potentials relative to chlorofluorocarbons and many chlorofluorocarbon substitutes. Furthermore, HFEs are listed as non-volatile organic compounds by the EPA, and as such are not considered as smog precursors.

WO 00/36206 discloses a dry cleaning composition comprising hydrofluoroether, 1-30 wt. % of a nonionic fluorosurfactant and less than 1 wt. % water. JP 11140499 discloses a dry cleaning composition comprising hydrofluoroether, 0 percent water and 10 and up to 90 wt. % of salt of a fluoralkyl phosphate surfactant. U.S. Pat. No. 6,127,430 discloses a composition comprising from 0.1 to 99 parts by weight of hydrofluoroether and from 99.9 to 1 parts by weight of water, the sum of a and b equalling 100 parts, and certain fluorinated surfactants. WO 97/22683 (3M) discloses a dry cleaning composition comprising hydrofluoroether and 0.1 wt. % of a nonionic surfactant like fluoralkyl sulphon amide. U.S. Pat. No. 5,610,128 discloses compositions with perfluoroalkylamine salts of octylphenyl acid phosphate.

However, this new class of non-flammable, non-chlorine containing organic dry cleaning solvents has major drawbacks. These solvents are often relatively poor solvents and show little or no cleaning activity on domestically stained and soiled laundry. In the absence of in-home dry cleaning, the known dry cleaning processes have been optimised for dry cleaning in an industrial setting which require large volumes of dry cleaning solvent and correspondingly large dry cleaning machines. These dry cleaning processes have been optimised to aggressively clean tough industrial stains with little garment care benefits. The large scale of the known dry cleaning process are less suitable for in-home dry cleaning and other non-industrial purposes. Furthermore, the conventional dry cleaning of laundry is carried out in specialized businesses. It requires expert knowledge of how to pretreat the tougher stains, how to treat certain types of laundry articles. It includes labor and time intensive post treatment steps such as pressing and ironing. For example, particulate soil is a common domestic stain that is difficult to clean using dry cleaning only without extensive manual pretreatment. Redeposition of soil often represents another problem in dry cleaning. Other common domestic stains such as kitchen grease are also difficult to remove with fluorinated solvents.

The present invention seeks to address one or more of the drawbacks mentioned above Surprisingly, according to one aspect of the invention a dry cleaning process for in-home dry cleaning is provided comprising a low aqueous dry cleaning step of contacting a laundry article with a low aqueous dry cleaning composition wherein the liquor to cloth ratio (w/w) (LCR) is at most 20, and wherein said low aqueous composition comprises a) at least one non-flammable, non-chlorine containing organic dry cleaning solvent;

b) 0.01 to 0.9 wt. % water and c) a cleaning effective amount of a surfactant wherein said surfactant comprises at least one anionic headgroup.

which overcomes one or more of the drawbacks mentioned above.

The inventive process according to this aspect of the invention shows surprisingly effective garment care and/or removal of domestic soils such as particulate soil, kitchen grease even in the absence of specific pretreatment.

Garment care including minimizing or avoiding wrinkles is a significant benefit since this would reduce the need for time and energy consuming ironing of the laundry articles. In addition, the present invention is particularly suitable for an in-home dry cleaning application because it is possible to use very low volumes of organic dry cleaning solvent (liquid to cloth ratio) and still obtain effective cleaning and/or garment care. Because low volumes of organic dry cleaning solvent are used, the dry cleaning process is highly suitable for non-industrial application since it can be carried out in a relatively small and cost effective dry cleaning apparatus.

These and other aspects, features and advantages will become apparent to those of ordinary skill in the art from a reading of the following detailed description and the appended claims. For the avoidance of doubt, any feature of one aspect of the present invention may be utilized in any other aspect of the invention. It is noted that the examples given in the description below are intended to clarify the invention and are not intended to limit the invention to those examples per se. Other than in the experimental examples, or where otherwise indicated, all numbers expressing quantities of ingredients or reaction conditions used herein are to be understood as modified in all instances by the term "about". Similarly, all percentages are weight/weight percentages of the total composition unless otherwise indicated. Numerical ranges expressed in the format "from x to y" are understood to include x and y. When for a specific feature multiple preferred ranges are described in the format "from x to y", it is understood that all ranges combining the different endpoints are also contemplated. Where the term "comprising" is used in the specification or claims, it is not intended to exclude any terms, steps or features not specifically recited. All temperatures are in degrees Celsius (° C.) unless otherwise specified. All measurements are in SI units unless otherwise specified. All documents cited are in relevant part, incorporated herein by reference.

DETAILED DESCRIPTION OF THE INVENTION

Definitions

The term "dry cleaning process" used herein is intended to mean any process wherein laundry articles are contacted with a dry cleaning composition within a closable vessel. However, as used herein this term does not include any process comprising steps wherein the laundry articles are also immersed and rinsed in an aqueous cleaning composition comprising more than 80 wt. % water because this would damage garments that can only be dry cleaned.

The term "dry cleaning composition" as used herein is intended to mean the composition used in the dry cleaning process including the dry cleaning solvent, any surfactant, cleaning agents but excluding the laundry articles that are to be cleaned.

The term "organic dry cleaning solvent" as used herein is intended to mean any non-aqueous solvent that preferably has a liquid phase at 20° C. and standard pressure. The term organic has its usual meaning, i.e., a compound with at least one carbon hydrogen bond.

When referring to the "weight of the cloth", it is intended to mean the weight of the cloth of the laundry article after the cloth has been equilibrated at 20° C., a relative humidity of 55% and standard pressure.

The term "laundry article" as used herein is typically a garment but may include any textile article. Textile articles include —but are not limited to —those made from natural fibers such as cotton, wool, linen, hemp, silk and man made fibers such as nylon, viscose, acetate, polyester, polyamide, polypropylene elastomer, natural or synthetic leather, natural or synthetic fur and mixtures thereof.

The term "liquid to cloth ratio" (w/w) (LCR) as used herein is intended to mean the ratio of the weight of the total amount of dry cleaning composition to the weight of the cloth as defined above.

The term "immerse" as used herein is intended to mean that the laundry article is contacted with a cleaning effective amount of dry cleaning composition in a step of the dry cleaning process to wet the laundry article which is usually a LCR of greater than 0.5 or more preferably a LCR as given below.

The term "cleaning effective amount" as defined herein is intended to mean an amount effective to obtain the desired cleaning.

The term "in-home" as defined herein is intended to mean that the LCR of the dry cleaning step is at most 20. Although, the in-home dry cleaning is especially suitable for domestic homes, in some cases these small appliances may also be used in hotels, airports on a non-industrial scale.

The water content refers to water purposefully added to the laundry articles, for example as part of the dry cleaning composition as such or a pretreatment composition, including hydrated water as part of ingredients making up these compositions. It is not intended to include the moisture of the untreated wash load e.g., a wet towel.

Dry Cleaning Process

According to a first aspect of the invention, a dry cleaning process is provided for in-home dry cleaning comprising a low aqueous dry cleaning step of contacting a laundry article with a low aqueous dry cleaning composition wherein the liquor to cloth ratio (w/w) (LCR) is at most 20, and wherein said low aqueous composition comprises a) at least one non-flammable, non-chlorine containing organic dry cleaning solvent;

b) 0.01 to 0.9 wt. % water and c) a cleaning effective amount of a surfactant wherein said surfactant comprises at least one anionic headgroup.

According to yet another aspect of the invention, one preferred dry cleaning process further comprises a non-aqueous dry cleaning step wherein the laundry article contacted with a non-aqueous dry cleaning composition, said non-aqueous dry cleaning composition comprising
0.001 to 10 wt. % of a surfactant;
0 to 0.01 wt. % of water;
0 to 50 wt. % of a cosolvent and
a non-flammable, non-chlorine containing organic dry cleaning solvent.

According to another aspect of the invention a sequential dry cleaning process is provided comprising:

a) a non-aqueous dry cleaning step, wherein said articles are contacted with a non-aqueous dry cleaning composition said non-aqueous dry cleaning composition comprising
0.001 to 10 wt. % of a surfactant;
0 to 0.01 wt. % of water;
0 to 50 wt. % of a cosolvent and a non-flammable, non-chlorine containing organic dry cleaning solvent;

b) at least one low-aqueous dry cleaning step, wherein said articles are contacted with a low aqueous dry cleaning composition said low aqueous dry cleaning composition comprising
0.001 to 10 wt. % of a surfactant;
0.01 to 50 wt. % of water;
0 to 50 wt. % of a cosolvent; and a non-flammable, non-chlorine containing organic dry cleaning solvent;

and, optionally, at least one rinsing step, wherein the articles are contacted with a rinse composition said rinse composition comprising
0 to 0.0001 wt. % of a surfactant;
0 to 10 wt. % of water;
0 to 50 wt. % of a cosolvent and
a non-flammable, non-chlorine containing organic dry cleaning solvent.

Depending on the desired cleaning, the low aqueous and non-aqueous compositions may be used in any order. However, in some cases it will be preferred to contact the articles with a non-aqueous composition prior to a low aqueous dry cleaning composition. In fact, the low aqueous dry cleaning step may be followed or preceded with various other steps such as a regeneration, garment care treatment and/or rinsing step, and, in fact, any other step known to the person skilled in the art.

We have found that some aspects of the present invention may be especially suitable for cleaning a laundry article stained with domestic stain material selected from the group including kitchen grease, particulate soil and mixtures thereof. Therefore, according to one embodiment the dry cleaning process preferably comprises the step of contacting a laundry article with a dry cleaning composition whereby the laundry article is stained with domestic stain material selected from kitchen grease, particulate soil and mixtures thereof. Typical particulate soil stains comprise any particulate matter which is capable of staining garments, such as dirt, mud, sand, charcoal, make up, deodorant, toothpaste but also corroded iron particles and mixtures thereof. Kitchen grease usually comprises edible fats and oils of animal or vegetable origin such as lard, sunflower oil, soy oil, olive oil, palm oil, peanut oil, rapeseed oil and mixtures thereof.

Generally, articles such as clothing are cleaned by contacting a cleaning effective amount of the dry cleaning composition according to one aspect of the invention with the articles for an effective period of time to clean the articles or otherwise remove stains. Preferably, the laundry article is immersed in the dry cleaning composition. The amount of dry cleaning composition used and the amount of time the composition contacts the article can vary based on equipment and the number of articles being cleaned. Normally, the dry cleaning process will comprise at least one step of contacting the article with dry cleaning composition according to the first aspect of the invention and at least one step of rinsing the article with a fresh load of dry cleaning solvent. The rinse composition will usually comprise of mainly solvent but cleaning agents may be added as desired.

We have found that the amount of dry cleaning composition used to clean a certain amount of laundry articles in a step of the dry cleaning process can be important. These amounts are expressed as the liquid to cloth ratio or LCR. Preferably the LCR is at most 20, more preferably at most 10, even more preferably at most 7 and preferably greater than 0.5, more preferably greater than 0.7, even more preferably greater than 1 and most preferably greater than 2.5. For the rinse step, the same LCR may be used wherein the "liquid" refers to the rinse composition which usually comprises only organic dry cleaning solvent with optionally some cleaning agents. When the dry cleaning process comprises different steps, the LCR of each step may be different or the same. Preferably, the LCR of each step is as described above.

The dry cleaning process may comprise different steps in any order depending on the desired outcome. The number and length of steps for e.g., cleaning, rinsing, conditioning steps may depend on the desired outcome. Each step may preferably last from at least 0.1 min, or preferably at least 0.5 min or more preferably at least 1 min or even 5 min, and at most 2 hrs, preferably at most 30 min, even more preferably at most 20 min and in some instances at most 5 min. In some cases longer times may be desired for example overnight.

Typically, each step comprises contacting the laundry article with a composition tailored for that step, e.g. a dry cleaning composition for a cleaning step, a rinsing composition for a rinsing step, a conditioning composition for a conditioning step. Sometimes these steps may be combined. For example the last rinsing step may also be a conditioning step when the composition comprises conditioning agents while it also rinses off any unwanted residues e.g. soil or surfactants. A step will normally comprise contacting the laundry article with a composition, agitating the laundry article in the composition, removing the composition from the laundry article. The removal may be carried out by any means known in the art such draining, spinning or when appropriate evaporating the composition, or any combination thereof.

The laundry articles in need of treatment are placed inside a closable vessel. It will be clear that the process is also suitable for cleaning one laundry article at the time although it will often be more efficient to clean more articles at the same time. Preferably, the vessel is a rotatable drum as part of an automated dry cleaning machine that is closed or sealed in such a way that the dry cleaning solvent can be contained within the machine if needed. Inside the vessel, the laundry articles are then contacted with the dry cleaning composition. This may be done in any way known in the art such as spraying or even using a mist.

In some cases it may be useful to formulate the dry cleaning composition in situ in the drum by contacting the different ingredients of the dry cleaning composition separately with the laundry articles. For example—when the dry cleaning composition comprises dry cleaning solvent, water and surfactant—first water, then surfactant followed by the dry cleaning solvent. Or first the dry cleaning solvent, followed by the surfactant and then water. Or any other order.

Alternatively, 2 or more of the ingredients may be premixed before they are contacted with the laundry articles. For example, water and surfactant may be premixed and this premix is then contacted with the laundry followed by the dry cleaning solvent. In the alternate, dry cleaning solvent and surfactant may be premixed and this premix is then contacted with the laundry followed by water.

Thus, in one preferred aspect, in situ formulation of the dry cleaning composition may also be provided by incorporating one or more ingredients of the dry cleaning composition into a pretreatment composition, pretreating the laundry articles with the pretreatment composition, contacting the laundry articles with the remaining ingredients of the dry cleaning composition thereby formulating the dry cleaning composition in situ. This pretreatment may take place manually outside the drum or mechanically inside the drum as part of a pretreatment step.

The pretreatment step per se need not be immersive, i.e., it may be limited to treating the stained areas only provided that when the laundry articles are contacted with all the ingredients making up the final dry cleaning composition, the laundry articles are immersed in said dry cleaning composition. For example—when the dry cleaning composition comprises of dry cleaning solvent, water and surfactant-stained areas of the laundry articles may be pre-treated with a premix of water and surfactant manually or by an automated process. After effective pretreatment time is allowed, the laundry articles may be contacted in the drum with the remaining ingredients such as in this case, the dry cleaning solvent (and optionally the remaining amounts of water and cleaning agent) to result in situ in the dry cleaning composition according to this aspect of the invention. The pretreatment time will be at least 5 sec but could be less than 1 day, preferably less than 1 hr, more preferably less than 30 min. The pretreatment composition may be formulated to treat specific stains. For example cleaning effective amounts of protease and other enzymes may be included to treat proteinacious stains.

In another preferred embodiment, the complete dry cleaning composition is premixed in a separate premix compartment. For example, when the dry cleaning composition comprises dry cleaning solvent, surfactant and water, these may be premixed in a separate compartment before the dry cleaning composition is contacted with the laundry article. Preferably such a premix is in the form of an emulsion or microemulsion.

Forming a premix of for example a water-in-oil emulsion can be brought about by any number of suitable procedures. For example, the aqueous phase containing a cleaning effective amount of surfactant package can be contacted with the solvent phase by metered injection just prior to a suitable mixing device. Metering is preferably maintained such that the desired solvent/water ratio remains relatively constant. Mixing devices such as pump assemblies or in-line static mixers, a centrifugal pump or other type of pump, a colloid mill or other type of mill, a rotary mixer, an ultrasonic mixer and other means of dispersing one liquid in another, nonmiscible liquid can be used to provide effective agitation to cause emulsification.

These static mixers are devices through which the emulsion is passed at high speed and in which said emulsion experiences sudden changes in direction and/or in the diameter of the channels which make up the interior of the mixers. This results in a pressure loss, which is a factor in obtaining a correct emulsion in terms of droplet size and stability.

In one variant of the method of the invention, the mixing steps are for example sequential. The procedure consists in mixing the solvent and emulsifier in a first stage, the premix being mixed and emulsified with the water in a second stage.

In another variant of the method of the invention, provision is made for carrying out the above steps in a continuous mode.

The premix may take place at room temperature, which is also the temperature of the fluids and raw materials used.

A batch process such as an overhead mixer or a continuous process such as a two fluid co-extrusion nozzle, an in-line injector, an in-line mixer or an in-line screen can be used to make the emulsion. The size of the emulsion composition in the final composition can be manipulated by changing the mixing speed, mixing time, the mixing device and the viscosity of the aqueous solution. In general, by reducing the mixing speed, decreasing the mixing time, lowering the viscosity of the aqueous solution or using a mixing device that produces less shear force during mixing, one can produce an emulsion of a larger droplet size. Especially preferred are ultrasonic mixers. Although the description above refers to the addition of surfactant it is understood it may also apply to the addition of cleaning agents.

While the laundry articles are in contact with the dry cleaning solvent, it is preferred to add mechanical energy for example by agitating or tumbling the laundry articles by rotating the drum or other means known in the art. Usually after one step, the dry cleaning solvent including any cleaning agents and/or loosened soil will be separated from the laundry articles. This is preferably done by spinning the laundry articles and collecting the dry cleaning composition, although other separation methods known in the art may also be employed such as evaporation. The dry cleaning solvent is then preferably recycled by separating the soil and/or cleaning agents from the solvent.

In other instances it may be advantageous to recirculate at least part of the dry cleaning composition during one step. For example by separating a portion of the dry cleaning composition from the laundry articles, optionally filtering soil from the separated portion of dry cleaning composition and contacting the laundry articles with the filtered portion of the dry cleaning composition.

The surfactants, dry cleaning solvents, cosolvents and optional cleaning agents used in present invention are described below and may be the same or different for each step of the inventive process.

The dry cleaning is usually performed at atmospheric pressure and room temperature, between 10 and 30° C. in most countries. In some instances the process temperature may be elevated to just under the boiling point of the most volatile dry cleaning solvent used. Sometimes the process may be performed under reduced or elevated pressure, typically achieved via a vacuum pump or by supplying a gas, such as nitrogen, to the apparatus thereby increasing the pressure the closable vessel. The dry cleaning process may be carried out in any suitable apparatus. Preferably, the apparatus will comprise a closable vessel and means to recycle the dry cleaning solvents used to minimize solvent losses into the environment. The dry cleaning composition may be in the form of a micro-emulsion but usually will be in the form of a macro-emulsion, which is generally accepted to be thermodynamically unstable. A suitable process and appliance for dry cleaning is described in U.S. Pat. No. 6,045,588. The solvent will preferably be filtered and recycled in the same appliance. Generally, the laundry articles will be agitated in the dry cleaning process by tumbling, rotating, ultrasonics or any suitable type of mechanical energy (see U.S. Pat. No. 6,045,588).

Still other advantages and novel features of the present invention will become apparent to those skilled in the art from the following detailed description, which presents, by way of illustration, various exemplary modes contemplated for carrying out the invention. As will be realized, the invention is capable of other different aspects and objects all without departing from the invention. Accordingly, advantages, aspects, and descriptions are illustrative in nature and not restrictive.

Dry Cleaning Solvent

The dry cleaning solvent is usually a non-flammable, non-chlorine containing organic dry cleaning solvent. Although the term dry cleaning solvent is used in the singular, it should be noted that a mixture of solvents may also be used. Thus, the singular should be taken to encompass the plural, and vice versa. Because of the typical environmental problems associated with chlorine containing solvents, the solvent preferably does not contain Cl atoms. In addition, the solvent should not be flammable such as most petroleum or mineral spirits having typical flash points as low as 20° C. or even lower. The term non-flammable is intended to describe dry cleaning solvents with a flash point of at least 37.8° C., more preferably at least 45° C., most preferably at least 50° C. The limit of a flashpoint of at least 37.8° C. for non-flammable liquids is defined in NFPA 30, the Flammable and Combustible Liquids Code as issued by National Fire Protection Association, 1996 edition, Massachusetts USA. Preferred test methods for determining the flash point of solvents are the standard tests as described in NFPA30. One preferable class of solvents is a fluorinated organic dry cleaning solvent including hydrofluorocarbon (HFC) and hydrofluoroether (HFE). However, even more preferred are non flammable non-halogenated solvents such as siloxanes (see below). It should be noted that mixtures of different dry cleaning solvents may also be used.

The most desirable solvents are non-ozone depleting and a useful common definition for the ozone depleting potential is defined by the Environmental Protection Agency in the USA: the ozone depleting potential is the ratio of the impact on ozone of a chemical compared to the impact of a similar mass of CFC-11. Thus, the ODP of CFC-11 is defined to be 1.0.

Hydrofluorocarbons

One preferred hydrofluorocarbon solvent is represented by the formula $C_xH_yF_{(2x+2-y)}$, wherein x is from 3 to 8, y is from 1 to 6, the mole ratio of F/H in the hydrofluorocarbon solvent is greater than 1.6.

Preferably, x is from 4 to 6 and most preferred x is 5 and y is 2.

Especially suitable are hydrofluorocarbon solvents selected from isomers of decafluoropentane and mixtures thereof. In particular useful is 1,1,1,2,2,3,4,5,5,5-decafluoropentane. The E.I. Du Pont De Nemours and Company markets this compound under the name Vertrel XF™.

Hydrofluoroethers

Hydrofluoroethers (HFEs) suitable for use in the present invention are generally low polarity chemical compounds minimally containing carbon, fluorine, hydrogen, and catenary (that is, in-chain) oxygen atoms. HFEs can optionally contain additional catenary heteroatoms, such as nitrogen and sulphur. HFEs have molecular structures which can be linear, branched, or cyclic, or a combination thereof (such as alkylcycloaliphatic), and are preferably free of ethylenic unsaturation, having a total of about 4 to about 20 carbon atoms. Such HFEs are known and are readily available, either as essentially pure compounds or as mixtures.

Preferred hydrofluoroethers can have a boiling point in the range from about 40° C. to about 275° C., preferably from about 50° C. to about 200° C., even more preferably from about 50° C. to about 121° C. It is very desirable that the hydrofluoroether has no flashpoint. In general, when a HFE has a flash point, decreasing the F/H ratio or decreasing the number of carbon-carbon bonds each decreases the flash point of the HFE (see WO/00 26206).

Useful hydrofluoroethers include two varieties: segregated hydrofluoroethers and omega-hydrofluoroalkylethers. Structurally, the segregated hydrofluoroethers comprise at least one mono-, di-, or trialkoxy-substituted perfluoroalkane, perfluorocycloalkane, perfluorocycloalkyl-containing perfluoroalkane, or perfluorocycloalkylene-containing perfluoroalkane compound.

HFEs suitable for use in the processes of the invention include the following compounds:

$C_4F_9OC_2F_4H$ $HC_3F_6OC_3F_6H$ $HC_3F_6OCH_3$ $C_5F_{11}OC_2F_4H$ $C_6F_{13}OCF_2H$ $C_6F_{13}OC_2F_4OC_2F_4H$ $c\text{-}C_6F_{11}CF_2OCF_2H$ $C_3F_7OCH_2F$ $HCF_2O(C_2F_4O)_n(CF_2O)CF_2H$, wherein m =0 to 2 and n =0 to 3

$C_3F_7O[C(CF_3)_2CF_2O]_pCFHCF_3$, wherein p=0 to 5

$C_4F_9OCF_2C(CF_3)_2CF_2H$ $HCF_2CF_2OCF_2C(CF_3)_2CF_2OC_2F_4H$ $C_7F_{15}OCFHCF_3$ $C_8F_{17}OCF_2O(CF_2)_5H$ $C_8F_{17}OC_2F_4OC_2F_4OC_2F_4OCF_2H$ $C_4F_9OC_2H_5$ $C_4F_9OCH_3$ $C_8F_{17}OCH_3$

Preferred HFEs are according to the formula $C_nX_{2n+1}—O—C_mY_{2m+1}$

Wherein X and Y are each independently F or H provided that at least one F is present. Preferably, X=F and Y=H; n=2-15 and m=1-10, but preferably, n=3-8 and m=1-4, or more preferably n=4-6 and m=1-3.

Especially preferred is a HFE wherein n=4 and m=1 or 2 which is marketed under the name of HFE 7100™ and 7200™ respectively by the 3M corporation.

Mixtures of different organic dry cleaning solvents may also be used. For example, a suitable dry cleaning composition may comprise a mixture of at least one HFE together with at least one siloxane.

When solvent compounds are mentioned, isomers thereof are also included. Thus, suitable HFEs include nonafluoromethoxybutane (C4F9OCH3) isomers such as 1,1,1,2,2,3,3,4,4-nonafluoro-4-methoxy-butane (CH3OCF2CF2CF2CF3), 1,1,1,2,3,3-hexafluoro-2-(trifluoromethyl)-3-methoxy-propane (CH3OCF2CF(CF3)2), 1,1,1,3,3,3-hexafluoro-2-methoxy-2-(trifluoromethyl)-propane (CH3OC(CF3)3), and 1,1,1,2,3,3,4,4,4-nonafluoro-2-methoxy-butane (CH3OCF(CF3)CF2CF3), approximate isomer boiling point=60° C.; Also isomers of nonafluoroethoxybutane (C4F9OC2H5) such as 1,1,1,2,2,3,3,4,4-nonafluoro-4-ethoxybutane (CH3CH2OCF2CF2CF2CF3), 1,1,1,2,3,3-hexafluoro-2-(trifluoromethyl)-3-ethoxypropane (CH3CH2OCF2CF(CF3)2), 1,1,1,3,3,3-hexafluoro-2-ethoxy-2-(trifluoromethyl)-propane (CH3CH2OC(CF3)3), and 1,1,1,2,3,3,4,4,4-nonafluoro-2-ethoxybutane (CH3CH2OCF(CF3)CF2CF3) with approximate isomer boiling points of 73° C.

Siloxane Dry Cleaning Solvent

Some siloxane solvents may also be used advantageously in the present invention. The siloxane may be linear, branched, cyclic, or a combination thereof. One preferred branched siloxane is tris (trimethylsiloxyl) silane. Also preferred are linear and cyclic oligo dimethylsiloxanes. One preferred class of siloxane solvents is an alkylsiloxane represented by the formula $R_3—Si(—O—SiR_2)_w—R$ Where each R is independently chosen from an alkyl group having form 1 to 10 carbon atoms and w is an integer from 1 to 30. Preferably, R is methyl and w is 1-4 or even more preferably w is 3 or 4.

Of the cyclic siloxane octamethyl cyclotetrasiloxane and decamethyl cyclopentasiloxane are particularly effective.

Very useful siloxanes are selected from the group consisting of decamethyl tetrasiloxane, dodecamethyl pentasiloxane and mixtures thereof.

Preferably, the organic dry cleaning solvent is not a terpene.

Especially suitable organic dry cleaning solvents include those selected from the group consisting of the isomers of nonafluoromethoxybutane, nonafluoroethoxybutane and decafluoropentane, octamethyl cyclotetrasiloxane, decamethyl cyclopentasiloxane, decamethyl tetrasiloxane, dodecamethyl pentasiloxane and mixtures thereof. Even more preferred organic dry cleaning solvents include those selected from the group consisting of octamethyl cyclotetrasiloxane, decamethyl cyclopentasiloxane, decamethyl tetrasiloxane, dodecamethyl pentasiloxane and mixtures thereof.

The dry cleaning compositions of the invention generally contain greater than about 50 percent by weight of organic dry cleaning solvent, preferably greater than about 75 weight percent, more preferably greater than about 80 weight percent, more preferably greater than about 85 weight percent, even more preferably greater than about 95 weight percent, but preferably less than 100 weight percent of organic dry cleaning solvent by weight of the total dry cleaning composition. Such amounts aid in improved drying times and maintain a high flashpoint or no flashpoint at all. For the rinse step or conditioning step the dry cleaning compositions may even comprise of at least 99 weight percent of organic dry cleaning solvent by weight of the total dry cleaning composition and sometimes even 100 weight percent of organic dry cleaning solvent.

Water

In some cases water may be used in the dry cleaning process and the amount of water is important. In those cases, the amount of water present in any step of the dry cleaning process is at such a level that laundry articles can be safely cleaned. This includes laundry articles that can only be dry cleaned. The amount of water present in the low aqueous dry cleaning composition is preferably from 0.01 to 50 wt. % water more preferably from 0.01 to 10 wt. %, even more preferably from 0.01 to 0.9 wt. % water by weight of the dry cleaning composition or more preferably, 0.05 to 0.8 wt. % or most preferable 0.1 to 0.7 wt. %. The amount of water present in the non-aqueous dry cleaning composition is preferably from 0 to 0.1 wt. % water by weight of the dry cleaning composition or more preferably, 0 to 0.01 wt. % or even more preferable 0 to 0.001 wt. % and most preferable 0 wt. %. When the dry cleaning composition comprises water, preferably the water to cloth ratio (w/w) (WCR) is less than 0.45, more preferably less than 0.35, more preferably less than 0.25, more preferably less than 0.2, most preferably less than 0.15, but usually more than 0.0001, preferably more than 0.001, more preferably more than 0.01.

When the dry cleaning process comprises more than one step, this WCR preferably applies to all steps in the dry cleaning process, especially when the dry cleaning composition comprises water and solvent. However, the WCR may or may not differ for each step. It is also preferred that this WCR applies to each steps in the dry cleaning process wherein the LCR is more than 1.

Cosolvents

The compositions of the invention may contain one or more cosolvents. The purpose of a cosolvent in the dry cleaning compositions of the invention is often to increase the solvency of the dry cleaning composition for a variety of soils. The cosolvent also enables the formation of a homogeneous solution containing a cosolvent, a dry cleaning solvent, and the soil; or a cosolvent, a dry cleaning solvent and an optional cleaning agent. As used herein, a "homogeneous composition" is a single phased composition or a composition that appears to have only a single phase, for example, a macro-emulsion, a micro-emulsion or an azeotrope. However, if a cosolvent is used the dry cleaning composition is preferably a non-azeotrope as azeotropes may be less robust.

Useful cosolvents of the invention are soluble in the dry cleaning solvent or water, are compatible with typical cleaning agents, and can enhance the solubilisation of hydrophilic composite stains and oils typically found in stains on clothing, such as vegetable, mineral, or animal oils. Any cosolvent or mixtures of cosolvents meeting the above criteria may be used.

Useful cosolvents include alcohols, ethers, glycol ethers, alkanes, alkenes, linear and cyclic amides, perfluorinated tertiary amines, perfluoroethers, cycloalkanes, esters, ketones, aromatics, the fully or partly halogenated derivatives thereof and mixtures thereof. Preferably, the cosolvent is selected from the group consisting of alcohols, alkanes, alkenes, cycloalkanes, ethers, esters, cyclic amides, aromatics, ketones, the fully or partly halogenated derivatives thereof and mixtures thereof.

Representative examples of cosolvents which can be used in the dry cleaning compositions of the invention include methanol, ethanol, isopropanol, t-butyl alcohol, trifluoroethanol, pentafluoropropanol, hexafluoro-2-propanol, methyl t-butyl ether, methyl t-amyl ether, propylene glycol n-propyl ether, propylene glycol n-butyl ether, dipropylene glycol n-butyl ether, propylene glycol methyl ether, ethylene glycol monobutyl ether, trans-1,2-dichloroethylene, decalin, methyl decanoate, t-butyl acetate, ethyl acetate, glycol methyl ether acetate, ethyl lactate, diethyl phthalate, 2-butanone, N-alkyl pyrrolidone (such as N-methylpyrrolidone, N-ethyl pyrrolidone), methyl isobutyl ketone, naphthalene, toluene, trifluorotoluene, perfluorohexane, perfluoroheptane, perfluorooctane, perfluorotributylamine, perfluoro-2-butyl oxacyclopentane.

Preferably, the cosolvent is present in the compositions of the invention in an effective amount by weight to form a homogeneous composition with the other dry cleaning solvent(s) such as HFE. The effective amount of cosolvent will vary depending upon which cosolvent or cosolvent blends are used and the other dry cleaning solvent(s) used in the composition. However, the preferred maximum amount of any particular cosolvent present in a dry cleaning composition should be low enough to keep the dry cleaning composition non-flammable as defined above.

In general, cosolvent may be present in the compositions of the invention in an amount of from about 1 to 50 percent by weight, preferably from about 5 to about 40 percent by weight, and more preferably from about 10 to about 25 percent by weight. In some exceptional cases the cosolvent may be present amounts of from about 0.01 percent by weight of the total dry cleaning composition.

Surfactants

The dry cleaning compositions of the invention can utilize many types of cyclic, linear or branched surfactants known in the art, both fluorinated and non-fluorinated. Preferred solvent compatible surfactants include nonionic, anionic, cationic and zwitterionic surfactants having at least 4 carbon atoms, but preferably less than 200 carbon atoms or more preferably less than 90 carbon atoms as described below. Solvent compatible surfactants usually have a solvent-philic part that increases the solubility of the surfactant in the dry cleaning solvent/composition. Effective surfactants may comprise of one or more polar hydrophilic groups and one or more dry cleaning solvent-philic parts having at least 4 carbon atoms so that the surfactant is soluble in said dry cleaning solvent/composition. It is preferred that the surfactant is soluble in the dry cleaning composition, i.e., to at least the amount of surfactant used in the dry cleaning composition at 20° C. The composition may comprise one or a mixture of surfactants depending on the desired cleaning and garment care. One preferred surfactant is an anionic surfactant. Another preferred surfactant is a cationic surfactant.

The polar hydrophilic group, Z, can be nonionic, ionic (that is, anionic, cationic, or amphoteric), or a combination thereof. Typical nonionic moieties include polyoxyethylene and polyoxypropylene moieties. Typical anionic moieties include carboxylate, sulfonate, sulfate, or phosphate moieties. Typical cationic moieties include quaternary ammonium, protonated ammonium, imidazolines, amines, diamines, sulfonium, and phosphonium moieties. Typical amphoteric moieties include betaine, sulfobetaine, aminocarboxyl, amine oxide, and various other combinations of anionic and cationic moieties. Especially suitable surfactants comprise at least one polar hydrophilic group Z which is an anionic moiety whereby the counterion may be as described below.

The polar hydrophilic group Z is preferably selected from the group comprising $—SO_4M$, $—SO_3M$, $—PO_4M_2$, $—PO_3M_2$, $—CO_2M$ and mixtures thereof wherein each M can be independently selected from the group including H, $NR_4$, Na, K and Li, wherein each R is independently selected from H and $C_{1-4}$ alkyl radical but preferably H. Preferably M is H but in some cases salts may also be used.

Fluorinated Surfactants

In one preferred embodiment, the surfactant is fluorinated or more preferably a fluorinated acid.

Suitable fluorosurfactants are in most cases those according to the formula (I):

$$(Xf)_n(Y)_m(Z)_p \quad (I)$$

and contain one, two or more fluorinated radicals (Xf) and one or more polar hydrophilic groups (Z), which radicals and polar hydrophilic groups are usually (but not necessarily) connected together by one or more suitable linking groups (Y). Preferably, n and p are integers independently selected from 1 to 4 and m is selected from 0 to 4. When the surfactant comprises more than one Xf, Y or Z group, then each of Xf, Y and Z may be the same or different. Preferably, the polar hydrophilic group is connected by a covalent bond to Y, or in absence of Y, to Xf.

The fluorinated radical, Xf, can generally be a linear or cyclic, saturated or unsaturated, aromatic or non-aromatic, radical preferably having at least 3 carbon atoms. The carbon chain may be linear or branched and may include hetero atoms such as oxygen or sulphur, but preferably not nitrogen. Preferably, Xf is an aliphatic and saturated. A fully fluorinated Xf radical is preferred, but hydrogen or chlorine may be present as substituents provided that not more than one atom of either is present for every two carbon atoms, and, preferably, the radical contains at least a terminal perfluoromethyl group. Radicals containing no more than about 20 carbon atoms are preferred because larger radicals usually represent a less efficient utilization of fluorine.

Especially suitable Xf groups can be based on perfluorinated carbon: $C_nF_{2n+1}$— wherein n is from 1-40, preferably 2 to 26, most preferably 2 to 18 or can be based on oligomers of hexafluoropropyleneoxide: $[CF(CF_3)—CF_2—O]_n$ wherein n is from 1 to 30. Suitable examples of the latter are marketed by E.I DuPont de Nemours and Co. under the name Krytox™ 157, especially, Krytox™ 157 FSL. Fluoroaliphatic radicals containing about 2 to 14 carbon atoms are more preferred.

The linking group, Y, is selected from groups such as alkyl, alkylene, alkylene oxide, arylene, carbonyl, ester, amide, ether oxygen, secondary or tertiary amine, sulfonamidoalkylene, carboxamidoalkylene, alkylenesulfonamidoalkylene, alkyleneoxyalkylene, or alkylenethioalkylene or mixtures thereof. In one preferred embodiment Y is $(CH_2)_t$ or $(CH_2)_tO$ wherein t is 1 to 10, preferably 1 to 6, most preferably 2 to 4. Alternatively, Y may be absent, in which case Xf and Z are directly connected by a covalent bond.

A particularly useful class of fluoroaliphatic surfactants useful in this invention are those wherein Xf, Y, and Z are as defined, and n is 1 or 2, m is 0 to 2, and p is 1 or 2.

Examples of very useful surfactants are those comprising at least wherein n is 1 to 4, m is 0 to 4, and p is 1 to 4, Z is as defined and $$Xf=R^1$$

$$Y=(R^2)_v$$

wherein $R^1$ is a perfluoroalkyl group having 1 to 40 carbon atoms; $R^2$ is an alkyl or an alkylene oxide group having 2 to 6 carbon atoms; and v is 0-10

Preferably, the surfactant is according to the formula $$[R^1—R^2{}_v]_wPO(OH)_{3-w}$$

wherein $R^1$ is a perfluoroalkyl group having 1 to 26 carbon atoms; $R^2$ is an alkyl or an alkylene oxide group having 2 to 6 carbon atoms; v is 0-10 and w is 1-2.

More preferably, $R^1$ is a perfluoroalkyl group having 2 to 16 carbon atoms; $R^2$ is an alkyl or an alkylene oxide group having 2 to 6 carbon atoms; v is 1 and w is 1 or 2.

Most preferably, $R^1$ is a perfluoroalkyl group having 2 to 14 carbon atoms; $R^2$ is ethylene oxide; v=1 and w=1-2.

Non-Fluorinated Surfactant

One other suitable class of surfactants are non-fluorinated surfactants according the formula (II):

$$(Xh)_n(Y)_m(Z)_p \quad (II)$$

wherein Xh is a non-fluorinated radical and (Y), (Z), n, m and p are as described above for formula (I).

Xh may be a linear, branched or cyclic, saturated or unsaturated, aromatic or non-aromatic, radical preferably having at least 4 carbon atoms. Xh preferably includes hydrocarbon radicals. When Xh is a hydrocarbon, the carbon chain may be linear, branched or cyclic and may include hetero atoms such as oxygen, nitrogen or sulphur, although in some cases nitrogen is not preferred. Preferably, Xh is aliphatic and saturated. Radicals containing no more than about 24 carbon atoms are preferred. One preferred surfactant is an acid surfactant. Preferred surfactants include anionic surfactants. Anionic surfactants are generally known in the art and include, for example, alkyl aryl sulfonates (such as, for example, alkylbenzenesulfonates), alkyl aryl sulfonic acids (such as, for example, sodium and ammonium salts of toluene-, xylene- and isopropylbenzenesulfonic acids), sulfonated amines and sulfonated amides (such as, for example, amidosulfonates), carboxylated alcohols and carboxylated alkylphenol ethoxylates, diphenyl sulfonates, fatty esters, isethionates, lignin-based surfactants, olefin sulfonates (such as, for example, RCH—$CHSO_3Na$, where R is $C_{10}$-$C_{16}$), phosphorous-based surfactants, protein based surfactants, sarcosine-based surfactants (such as, for example, N-acylsarcosinates such as sodium N-lauroylsarcosinate), sulfates and sulfonates of oils and/or fatty acids, sulfates and sulfonates of ethoxylated alkylphenols, sulfates of alcohols, sulfates of ethoxylated alcohols, sulfates of fatty esters, sulfates of aromatic or fluoro containing compounds, sulfosuccinnamates, sulfosuccinates (such as, for example, diamyl-, dioctyl- and diisobutylsulfosuccinates), taurates, and sulfonic acids. Examples of suitable non-fluorinated anionic surfactants include Crodafos™ 810A (ex Croda).

Other classes of suitable surfactants include, but are not limited to nonionic and cationic surfactants. Compounds suitable for use as the nonionic surfactant of the present invention are those that carry no discrete charge when dissolved in aqueous media. Nonionic surfactants are generally known in the art and include, for example, alkanol amides (such as, for example, coco, lauric, oleic and stearic monoethanolamides, diethanolamides and monoisopropanolamides), amine oxides (such as, for example, polyoxyethylene ethanolamides and polyoxyethylene propanolamides), polyalkylene oxide block copolymers (such as, for example, poly(oxyethylene-co-oxypropylene)), ethoxylated alcohols, (such as, for example, isostearyl polyoxyethylene alcohol, lauryl, cetyl, stearyl, oleyl, tridecyl, trimethylnonyl, isodecyl, tridecyl), ethoxylated alkylphenols (such as, for example, nonylphenol), ethoxylated amines and ethoxylated amides, ethoxylated fatty acids, ethoxylated fatty esters and ethoxylated fatty oils (such as, for example, mono- and diesters of acids such as lauric, isostearic, pelargonic, oleic, coco, stearic, and ricinoleic, and oils such as castor oil and tall oil), fatty esters, fluorocarbon containing materials, glycerol esters (such as, for example, glycerol monostearate, glycerol monolaurate, glycerol dilaurate, glycerol monoricinoleate, and glycerol oleate), glycol esters (such as, for example, propylene glycol monostearate, ethylene glycol monostearate, ethylene glycol distearate, diethylene glycol monolaurate, diethylene glycol monolaurate, diethylene glycol monooleate, and diethylene glycol stearate), lanolin-based surfactants, monoglycerides, phosphate esters, polysaccharide ethers, propoxylated fatty acids, propoxylated alcohols, and propoxylated alkylphenols, protein-based organic surfactants, sorbitan-based surfactants (such as, for example, sorbitan oleate, sorbitan monolaurate, and sorbitan palmitate), sucrose esters and glucose esters, and thio- and mercapto-based surfactants.

In a preferred embodiment, one component of the present invention comprises one or more nonionic surfactants according to one or more of the structural formulas III and IV:

$$R^9—O—(CH_2—CH_2—O)_n—R^{10} \quad (III)$$

$$R^9—O—(CH_2—C(CH_3)H—O)_n—R^{10} \quad (IV)$$

wherein:

$R^9$ is a monovalent hydrocarbon group of from 1 to 30 carbons that may be linear, cyclic, branched, unsaturated, aromatic or fluoro containing; $R^{10}$ is hydrogen or a monovalent hydrocarbon group of 1 to 30 carbons that may be linear, cyclic, branched, unsaturated, aromatic or fluoro containing; and n is from about 1 to about 100, more preferably from about 1 to about 40. In a highly preferred embodiment, $R^9$ contains from 2 to about 24 carbons, even more preferably from 8 to 24 carbons, $R^{10}$ is H and n is from about 2 to about 20.

Other suitable nonionic surfactants include Polyethylene oxide condensates of nonyl phenol and myristyl alcohol, such as in U.S. Pat. No. 4,685,930 Kasprzak; and b) fatty alcohol ethoxylates, $R—(OCH_2CH_2)_aOH$ wherein a=1 to 100, typically 1 to 30, R=hydrocarbon residue 8 to 20 C atoms, typically linear alkyl. Examples polyoxyethylene lauryl ether, with 4 or 10 oxyethylene groups; polyoxyethylene cetyl ether with 2, 6 or 10 oxyethylene groups; polyoxyethylene stearyl ether, with 2, 5, 15, 20, 25 or 100 oxyethylene groups; polyoxyethylene (2), (10) oleyl ether, with 2 or 10 oxyethylene groups. Commercially available examples include, but are not limited to: BRIJ and NEODOL. See also U.S. Pat. No. 6,013,683 Hill et al. Other suitable nonionic surfactants include Tween™.

Suitable cationic surfactants include, but are not limited to dialkyldimethyl ammonium salts having the formula: $R'R''N^+(CH_3)_2X^-$ wherein R' and R" are each independently selected from the group consisting of hydrocarbon containing moiety containing 1-30 C atoms or derived from tallow, coconut oil or soy, X=Cl, I or Br. Examples include: didodecyldimethyl ammonium bromide (DDAB), dihexadecyldimethyl ammonium chloride, dihexadecyldimethyl ammonium bromide, dioctadecyldimethyl ammonium chloride, dieicosyldimethyl ammonium chloride, didocosyldimethyl ammonium chloride, dicoconutdimethyl ammonium chloride, ditallowdimethyl ammonium bromide (DTAB). Commercially available examples include, but are not limited to: ADOGEN, ARQUAD, TOMAH, VARIQUAT. See also U.S. Pat. No. 6,013,683 Hill et al.

Also suitable surfactants are silicone surfactants including, but not limited to the polyalkyleneoxide polydimethylsiloxanes having a polydimethylsiloxane hydrophobic moiety and one or more hydrophilic polyalkyleneoxide side chains and have the general formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 3 to about 30, more preferably from about 10 to about 25, and each $R^1$ is the same or different and is selected from the group consisting of methyl and a poly(ethyleneoxide/propyleneoxide) copolymer group having the general formula:

$—(CH_2)_nO(C_2H_4O)_c(C_3H_6O)_dR^2$ with at least one $R^1$ being a poly(ethyleneoxide/propyleneoxide) copolymer group, and wherein n is 3 or 4, preferably 3; total c (for all polyalkyleneoxide side groups) has a value of from 0 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group. Examples of these surfactants may be found in U.S. Pat. No. 5,705,562 and U.S. Pat. No. 5,707,613, both of which are incorporated herein by reference.

Examples of this type of surfactants are the Silwet™ surfactants which are available from CK Witco, OSi Division, Danbury, Conn. Representative Silwet™ surfactants are for example L-7608, L-7607, L-77, L-7605, L-7604, L-7600, L-7657, L-7602. The molecular weight of the polyalkyleneoxide group ($R^1$) is less than or equal to about 10,000. Preferably, the molecular weight of the polyalkyleneoxide group is less than or equal to about 8,000, and most preferably ranges from about 300 to about 5,000. Thus, the values of c and d can be those numbers which provide molecular weights within these ranges. However, the number of ethyleneoxide units ($—C_2H_4O$) in the polyether chain ($R^1$) must be sufficient to render the polyalkyleneoxide polysiloxane water dispersible or water soluble. If propyleneoxide groups are present in the polyalkyleneoxide chain, they can be distributed randomly in the chain or exist as blocks. Especially preferred Silwet™ surfactants are L-7600, L-7602, L-7604, L-7605, L-7657, and mixtures thereof. Besides cleaning and/or emulsifying activity, polyalkyleneoxide polydimethylsiloxane surfactants can also provide other benefits, such as anti-static benefits, and softness to fabrics.

The preparation of polyalkyleneoxide polydimetylsiloxanes is well known in the art. Polyalkyleneoxide polydimethylsiloxanes of the present invention can be prepared according to the procedure set forth in U.S. Pat. No. 3,299,112, incorporated herein by reference.

Another suitable silicone surfactant is SF-1488, which is available from GE silicone fluids. Especially preferred silicone surfactants include Tegopren™ 7008 and 7009 (ex Goldschmidt).

These and other surfactants suitable for use in combination with the organic dry cleaning solvent as adjuncts are well known in the art, being described in more detail in Kirk Othmer's Encyclopaedia of Chemical Technology, 3rd Ed., Vol. 22, pp. 360-379, "Surfactants and Detersive Systems", incorporated by reference herein. Further suitable nonionic detergent surfactants are generally disclosed in U.S. Pat. No. 3,929,678, Laughlin et al., issued Dec. 30, 1975, at column 13, line 14 through column 16, line 6, incorporated herein by reference. Other suitable detergent surfactants are generally disclosed in WO-A-0246517.

The surfactant or mixture of surfactants is present in a cleaning effective amount. A cleaning effective amount is the amount needed for the desired cleaning. This will, for example, depend on the number of articles, level of soiling and volume of dry cleaning composition used. However, surprisingly effective cleaning was observed when the surfactant was present from at least 0.001 wt. % to 10 wt. % by weight of the dry cleaning composition. More preferably, the surfactant is present from 0.01 to 3 wt. % or even more preferably from 0.05 to 0.9 wt. % by weight of the dry cleaning composition. More preferably, the surfactant is present from 0.1 to 0.8 wt. % or even more preferably from 0.3 to 0.7 wt. % by weight of the dry cleaning composition.

Surprisingly, it was found that the surfactant to cloth ratio (w/w) (SCR) was important in many cases to obtain an effective cleaning while maintaining a good garment care. Preferably, the SCR is at most 0.25, more preferably at most 0.12, more preferably at most 0.08, more preferably at most 0.04, but preferably at least 0.0001, more preferably at least 0.0003, more preferably at least 0.001 and most preferably at least 0.002.

Optional Cleaning Agents

The dry cleaning compositions may contain one or more optional cleaning agents. Cleaning agents include any agent suitable for enhancing the cleaning, appearance, condition and/or garment care. Generally, the cleaning agent may be present in the compositions of the invention in an amount of about 0 to 20 wt. %, preferably 0.001 wt. % to 10 wt. %, more preferably 0.01 wt. % to 2 wt. % by weight of the total dry cleaning composition. Some suitable cleaning agents include, but are not limited to, builders, enzymes, bleach activators, bleach catalysts, bleach boosters, bleaches, alkalinity sources, antibacterial agents, colorants, perfumes, properfumes, finishing aids, lime soap dispersants, composition malodour control agents, odor neutralizers, polymeric dye transfer inhibiting agents, crystal growth inhibitors, photobleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, process aids, fabric softening agents, optical brighteners, hydrotropes, suds or foam suppressors, suds or foam boosters, anti-static agents, dye fixatives, dye abrasion inhibitors, wrinkle reduction agents, wrinkle resistance agents, soil repellency agents, sunscreen agents, anti-fade agents, and mixtures thereof.

The invention is more fully illustrated by the following non-limiting examples showing some preferred embodiments of the invention.

EXAMPLES

Laundry articles are contacted with the following low aqueous dry cleaning compositions A (see table I) and agitated for 15 minutes at 20° C. using a liquid to cloth ratio of 13. Subsequently, the dry cleaning composition is removed and the laundry articles are rinsed with a rinse composition comprising clean dry cleaning solvent. The experiment is repeated with following low aqueous dry cleaning compositions B-F (see table I) using an liquid to cloth ratio of 5.

TABLE I

| | | Composition | | | | | |
|---|---|---|---|---|---|---|---|
| | | A | B | C | D | E | F |
| Surfactant (wt. %) | Zonyl UR ™ | 0.5 | 0.5 | | | | |
| | Crodafos ™ 810A (ex Croda) | | | 0.1 | 0.5 | 0.1 | 0.5 |
| Water | | 0.1 | 0.5 | 0.5 | 0.5 | 0.5 | 0.5 |
| Solvent (Balance) | | | | | | | |
| HFE-7200 ™ | | X | X | | | | |

TABLE I-continued

| | Composition | | | | | |
|---|---|---|---|---|---|---|
| | A | B | C | D | E | F |
| Dodecamethyl pentasiloxane | | | X | | | |
| Decamethyl tetrasiloxane | | | | x | | |
| Decamethyl cyclopentasiloxane | | | | | x | x |

Zonyl ™ UR fluorosurfactant is available from E. I DuPont de Nemours and Co. Nonafluoromethoxybutane is marketed under the name HFE-7100 ™ by the 3M Company.

The invention claimed is:

1. A dry cleaning process for in-home dry cleaning consisting of a first step of contacting a laundry article with a low aqueous dry cleaning composition wherein the liquor to cloth ratio (w/w) (LCR) is at most 10, wherein said low aqueous composition comprises a) at least one non-flammable, non-chlorine containing organic dry cleaning solvent;

b) 0.1 to 0.7 wt. % water and c) a cleaning effective amount of a surfactant wherein said surfactant comprises at least one anionic headgroup and a subsequent step of rinsing the article with only clean dry cleaning solvent comprising 0 to 0.000 1 wt. % of a surfactant;

0 wt. % of water;

0 to 50 wt. % of a cosolvent and a non-flammable, non-chlorine containing organic dry cleaning solvent.

2. A dry cleaning process for in-home dry cleaning according to claim 1 wherein the surfactant is an acid.

3. A dry cleaning process for in-home dry cleaning according to claim 1 whereby said liquid to cloth ratio (w/w) is at most 7.

4. A dry cleaning process for in-home dry cleaning according to claim 1 wherein the water to cloth ratio (w/w) during the low aqueous dry cleaning step is less than 0.45.

5. A dry cleaning process for inhome dry cleaning according to claim 1 wherein the surfactant comprises at least one polar hydrophilic group selected from —$SO_4M$, —$SO_3M$, —$PO_4M_2$, —$PO_3M_2$, —$CO_2M$ and mixtures thereof wherein each M can be independently selected from the group including H, $NR_4$, Na, K and Li, wherein each R is independently selected from H and $C_{1-4}$ alkyl radical.

6. A dry cleaning process according to claim 1 wherein the non-flammable, non-chlorine containing organic dry cleaning solvent is selected from the group consisting of the isomers of nonafluoromethoxybutane, nonafluoroethoxybutane and decafluoropentane, octamethyl cyclotetrasiloxane, decamethyl cyclopentasiloxane, decamethyl tetrasiloxane, dodecamethyl pentasiloxane and mixtures thereof.

7. A dry cleaning process for inhome dry cleaning according to claim 1 whereby the laundry article is stained with domestic stain material selected from kitchen grease, particulate soil and mixtures thereof.

8. A dry cleaning process for inhome dry cleaning according to claim 1 wherein the water to cloth ratio (w/w) is less than 0.25 in each step of the dry cleaning process wherein the LCR is more than 1.

* * * * *